United States Patent [19]

Lidén

[11] Patent Number: 4,685,409

[45] Date of Patent: Aug. 11, 1987

[54] DEVICE FOR THE STORING OF OIL

[75] Inventor: Hadar Lidén, Västra Frölunda, Sweden

[73] Assignee: Götaverken Arendal AB, Sweden

[21] Appl. No.: 737,447

[22] Filed: May 24, 1985

[30] Foreign Application Priority Data

Jun. 1, 1984 [SE] Sweden ..... 8402977

[51] Int. Cl.[4] ..... B63B 3/02

[52] U.S. Cl. ..... 114/74 R; 114/266; 137/573

[58] Field of Search ..... 114/74 R, 74 A, 74 T, 114/125, 26, 45, 49, 256, 257, 266; 405/212, 210; 210/195.1, 336; 141/35; 137/571–576

[56] References Cited

U.S. PATENT DOCUMENTS

| | | | |
|---|---|---|---|
| 592,721 | 10/1897 | Barnhart | 137/573 |
| 3,931,008 | 1/1976 | Page et al. | 210/195.1 |
| 3,992,300 | 11/1976 | Hill | 210/195.1 |
| 4,200,411 | 4/1980 | Brown et al. | 114/257 |

FOREIGN PATENT DOCUMENTS

| | | | |
|---|---|---|---|
| 323902 | 5/1970 | Sweden | 114/74 R |

*Primary Examiner*—Joseph F. Peters, Jr.
*Assistant Examiner*—Jesûs D. Sotelo
*Attorney, Agent, or Firm*—Wegner & Bretschneider

[57] ABSTRACT

In order to facilitate temporary storing of oil in an underwater receptacle, for instance the pontoon of a semi-submersible vessel, the receptacle is subdivided by bulkheads into a series of tanks. A first tank is connected to a production unit by way of a conduit, or by way of a branch pipe to a delivery conduit. The tank located remotely with respect to the conduit communicates with the surrounding sea by an opening. The bulkheads are provided with upper and lower openings, respectively, and a screened passage extends between these openings. When oil is supplied to the first tank static or pump pressure will expel water through opening, and oil will fill the tanks in due order in the direction away from the first tank. When oil is withdrawn, water from the surrounding sea will flow in through opening and further on through the tanks towards the first tank.

3 Claims, 4 Drawing Figures

DEVICE FOR THE STORING OF OIL

BACKGROUND OF THE INVENTION

Many problems are involved in the offshore oil production. Conventionally one unit is used for drilling and preparing the well for production, and a further unit will be responsible for the continued production. Certain bigger units are equipped for drilling as well as for production. Depending upon the local depth of the water, the production units may be supported directly from the bottom of the sea, or be located at a vessel, usually of the semi-submersible type.

An evident problem pertaining to all handling of oil is the environmental damages caused by escaping oil. When a well is located so far out, that it is not warranted to connect it with land by a pipeline, it will be necessary to provide some storing facility for the continous production, and means for transfer to a transport vessel.

The object of the present invention is to propose a device for the storing of oil e.g. at an offshore production unit, by using an underwater receptacle, of simple design, requiring low labour input for the handling of the oil, and which is safe from environmental point of view.

SUMMARY OF THE INVENTION

A device according to the invention is characterized by openings at the upper and the lower portion, respectively, of a bulkhead separating two tanks in a series of tanks, as well as means for forming a passage between those openings, a conduit connected to a first tank in the series for the supply and withdrawal, respectively, of oil, and an open connection between the tank located remotely with respect to the conduit connection, and the surrounding sea.

The receptacle can advantageously be composed of annular elements, each provided with an end wall adjacent to both ends, said end walls being provided with the desired openings and forming between themselves the desired passage when two elements are fitted together.

When the bulkheads are made of steel plate reinforced by vertical flanges, one of the openings is preferably located in the bulkhead between two adjacent flanges, these two flanges being interconnected by a cover plate, while the other opening is located in this cover plate.

DESCRIPTION

Figure 1:
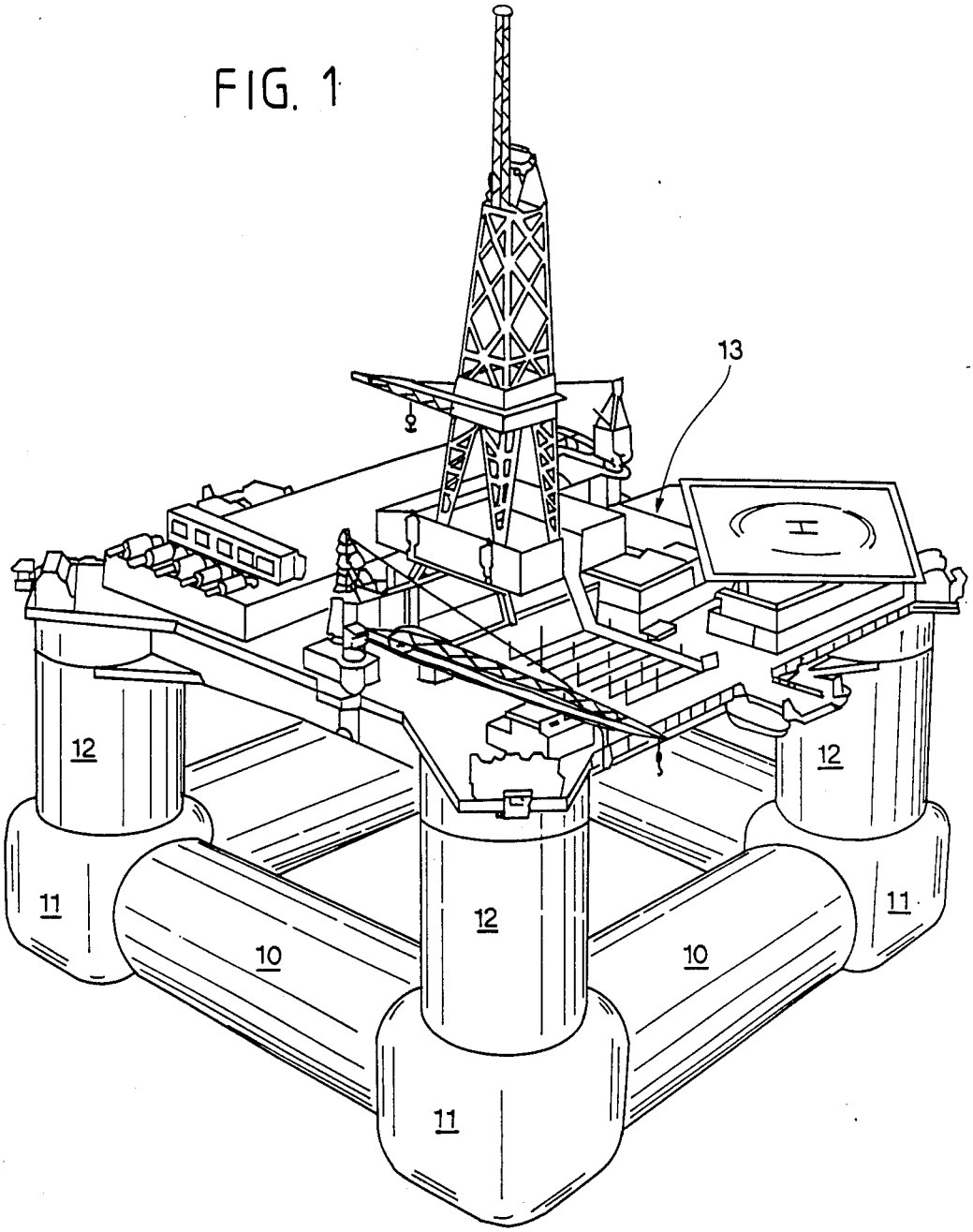
FIG. 1 shows a perspective view of a semi-submersible vessel equipped for production and for storing of oil and in at least part of its underwater pontoons.

The semi-submersible vessel shown in FIG. 1 is equipped for drilling and for temporary storing of oil. It basically includes a underwater pontoon structure composed of four horizontal, cylindrical parts 10 interconnected by corner units 11 to a square ring. A pillar 12 is supported by each of these units, and carries an operating deck 13, which in conventional manner includes housing for the staff, stores and equipment for drilling, as well as for handling of the oil produced.

On the present occasion the pontoons, the corner units and the columns are composed of pre-produced sections of reinforced concrete. The pontoons are in conventional manner subdivided into tanks for ballasting the vessel. Some of the tanks will be used for the temporary storing of oil.

Figure 2:
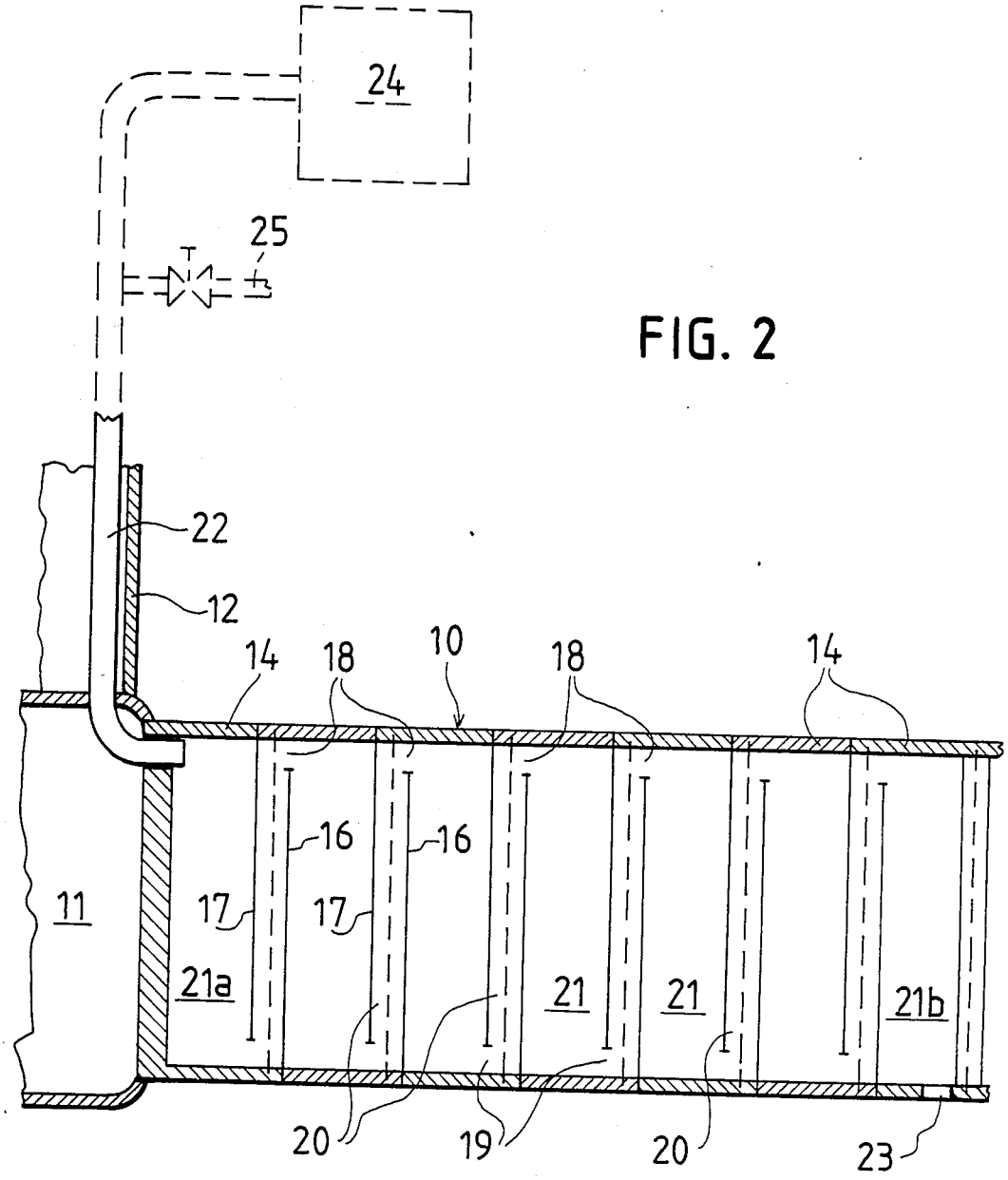
FIG. 2 shows a vertical section through a portion of an underwater pontoon and a pillar resting thereon.
Figure 3:
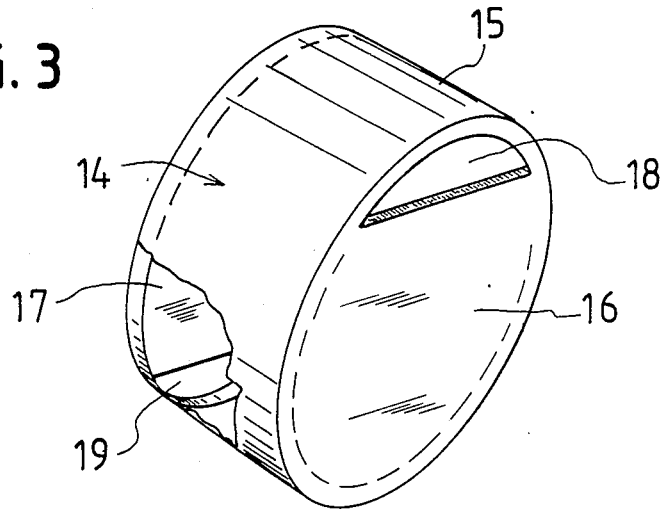
FIG. 3 shows a perspective view of an element forming part of a pontoon.
Figure 4:
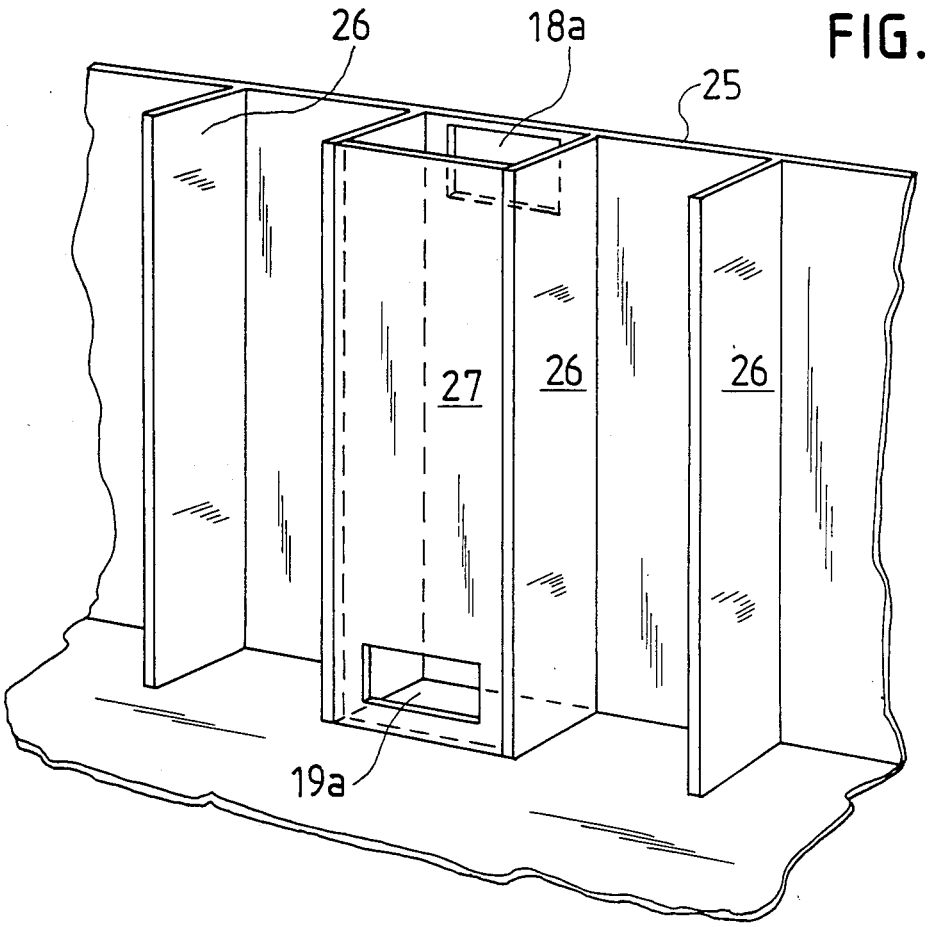
FIG. 4 shows a detail of a modified design of the passage at a bulkhead.

FIG. 2 shows a vertical section through a portion of one of the pontoons 10 and of an adjoining corner unit 11 and a column 12 resting theron. The pontoon is composed of a number of annular elements 14 of the type shown in FIG. 3, each having a cylindrical envelope wall 15 and two end walls 16 and 17, respectively. In the portion of the end wall 16, which in mounted position is turned upwards a first opening 18 is provided, while there is an other opening 19 at the lower portion of the other end wall 17.

When two elements 14 are fitted together the juxtaposed end walls 16, 17 of the two elements will form the separating bulkhead and the space between them will form a passage 20, interconnecting the two openings 18 and 19. All tanks 21 within a row of adjacent elements 14 selected for the storing of oil will thus communicate to form a series.

The tank 21*a* adjacent to the corner unit 11 is sealed from the latter, and a conduit 22 is connected to this tank, and extends through the column 12 and the corner unit 11.

The tank 21*b* in the series located remotely with respect to the corner unit is provided with an opening 23 at the portion of its envelope wall turned downward. This opening is normally open to the sea, but can evidently be provided with closure means so the pontoon may be occasionally pumped dry.

A processing plant is in FIG. 2 schematically denoted at 24. The column 12 and the operating platform 13 has such a height, that the vertical portion of the conduit 22 will provide a static pressure which is sufficient for the oil supplied to expell sea water through the tanks 21. By suitable pump means the flow velocity can of course be increased.

The transfer of oil from the tanks 21 to a transport vessel occurs by way of a branch pipe 25, located so a noticeable part of conduit 22 can be utilized.

During production tank 21*a* is first filled, the water therein being expelled through passage 20 to the adjacent tank, and so on, the corresponding quantity of water being expelled through opening 23 at remote tank 21*b*. Step by step the tanks are filled with oil in the direction away from tank 21*a*. By monitoring the flow of oil due care is taken that the level of oil will not approach opening 23. There will be a clear dividing level between oil and water, and preferably oil should not enter tank 21*b* at all, or in any case not be permitted to fill more than the upper half thereof. When oil is withdrawn through branch pipe 25 the pressure of the surrounding water will fill the tanks in succession, so the oil is forced towards tank 21*a*.

Further conduits (not shown) are in the conventional manner provided to evacuate air from the tanks during the first filling of the tanks with sea water, and there should of course be man-holes with covers making possible a communication between the tanks for survey.

Certain tanks within the portion frame are used for ballast water only. The difference in gravity between the crude oil and the sea water is not very big, and will not markedly influence the ballasting capacity of the oil storing tanks—these are either filled with water or with oil.

When the receptacle is made as a conventional steel structure and the transverse bulkheads 28 are reinforced by flanges, either in the form of vertical corrugations at the bulkhead plate, or by frames 26 welded thereto, it is possible to screen-off the space between two flanges by means of a cover plate 27. One opening 18*a* will then be provided in the bulkhead plate, while the other opening 19*a* is located in the cover plate 27. Alternatively a pipe can be attached vertically to the conduit. One end of the pipe is then open to one of the tanks, while the other end of the pipe extends through the bulkhead and communicates with the adjacent tank.

The embodiments shown are examples only and should not be regarded as limiting the scope of the invention. The receptacle can be formed in various ways, and preferably there are perforated distribution and collecting conduits within the tanks forming continuations of the openings 18, 19. These conduits will ensure a smooth flow of oil and water, respectively.

What I claim is:

1. A device for storing a fluid in an underwater receptacle having a series of elements, each element having end walls and forming a series of tank means for storing the fluid and in fluid communication one with the other, comprising:

at least a pair end walls formed by bulkheads in each of said tank means;

openings formed in the end walls of each said tank means such that one end wall has an opening on the upper portion thereof and the other end wall has an opening in the lower portion thereof, said end walls being arranged in a sequence such that an end wall having an opening in the lower portion thereof is arranged next to a tank means end wall having an opening in the upper portion thereof for fluid communication between the tanks means;

means forming a fluid passage between openings in adjacent end walls;

a conduit connected to a first tank means in the series of tanks means for the supply and withdrawal of the fluid to be stored in said tanks means; and an orifice in said receptacle in the tank means located remotely from said first tank means in said series, said orifice allowing fluid communication between said remotely located tank means and the surrounding environment.

2. The device defined in claim 1 wherein said elements are cylindrical.

3. A device for storing a fluid in an underwater receptacle, comprising:

a plurality of bulkhead assemblies subdividing said receptacle into a series of tanks for storing the fluid, each said bulkhead assembly being constructed from a steel plate reinforced by a plurality of vertical flanges;

openings formed in, respectively, the upper and lower portion of each of bulkhead assemblies separating two tanks, one of said openings being located in the bulkhead assemblies plate between two adjacent flanges;

means forming a fluid passage between adjacent upper and lower portion openings, a cover plate interconnecting said two flanges to form said passage;

a conduit connected to a first tank in the series of tanks for the supply and withdrawal of the fluid being stored; and an orifice for fluid communication between the tank located most remotely from said first tank in the series and the surrounding environment.

* * * * *